US012428867B2

(12) United States Patent
VanBasten

(10) Patent No.: US 12,428,867 B2
(45) Date of Patent: Sep. 30, 2025

(54) AIRMAST INFLATABLE TOWER

(71) Applicant: Air Shelters USA, LLC, Hatboro, PA (US)

(72) Inventor: Willem VanBasten, Hatboro, PA (US)

(73) Assignee: Air Shelters USA, LLC, Hatboro, PA (US)

( * ) Notice: Subject to any disclaimer, the term of this patent is extended or adjusted under 35 U.S.C. 154(b) by 64 days.

(21) Appl. No.: 18/220,131

(22) Filed: Jul. 10, 2023

(65) Prior Publication Data

US 2024/0011315 A1 Jan. 11, 2024

Related U.S. Application Data

(60) Provisional application No. 63/359,631, filed on Jul. 8, 2022.

(51) Int. Cl.

| | |
|---|---|
| ***E04H 12/18*** | (2006.01) |
| ***E04H 12/20*** | (2006.01) |
| ***E04H 12/34*** | (2006.01) |

(52) U.S. Cl.
CPC ..... *E04H 12/18* (2013.01); *E04H 12/20* (2013.01); *E04H 12/34* (2013.01)

(58) Field of Classification Search
CPC ..... E04H 15/20; E04H 12/18; E04H 12/34
See application file for complete search history.

(56) References Cited

U.S. PATENT DOCUMENTS

| | | | | |
|---|---|---|---|---|
| 3,278,938 | A * | 10/1966 | Rosenthal | H01Q 1/081 52/2.22 |
| 3,364,488 | A * | 1/1968 | Perenic | H01Q 1/081 343/723 |
| 3,484,788 | A * | 12/1969 | Bell | H01Q 1/1235 343/900 |
| 6,322,230 | B1 * | 11/2001 | Medici | F21V 3/026 362/486 |
| 7,621,650 | B2 * | 11/2009 | Nalitchaev | E01F 9/617 446/226 |
| 8,328,377 | B1 * | 12/2012 | Kothari | F21V 21/00 362/486 |
| 8,684,327 | B2 * | 4/2014 | Caswell | F21S 8/08 52/2.13 |
| 8,959,870 | B2 | 2/2015 | Schmidt | |
| 9,050,513 | B2 * | 6/2015 | Caswell | F16M 11/42 |
| 10,082,239 | B2 * | 9/2018 | Caswell | A63B 63/00 |
| 11,105,485 | B2 * | 8/2021 | Kothari | F21V 3/026 |
| 11,181,248 | B1 * | 11/2021 | Kothari | F21V 23/007 |

(Continued)

OTHER PUBLICATIONS

International Search Report Issued in co-pending application No. PCT/US23/27276, dated Nov. 17, 2023.

*Primary Examiner* — Andrew J Triggs
(74) *Attorney, Agent, or Firm* — Whiteford, Taylor & Preston, LLP; Peter J. Davis

(57) ABSTRACT

An inflatable equipment support tower having one or more inflation tubes and inflation valves and equipment mounted in a portable housing, and an equipment platform either mounted on a top of the inflation tubes or configured to move to any point on the inflation tube(s) after full inflation. The housing is configured to be compact and portable, preferably sized to fit inside the trunk or storage compartment of an emergency vehicle. Larger versions may be configured to be towable or mounted on the top of emergency vehicles.

10 Claims, 10 Drawing Sheets

(56) References Cited

U.S. PATENT DOCUMENTS

| | | | | |
|---|---|---|---|---|
| 2005/0126082 | A1* | 6/2005 | Boschma | E04H 12/02 52/2.11 |
| 2005/0224545 | A1* | 10/2005 | Boschma | E04H 12/20 224/403 |
| 2015/0247603 | A1* | 9/2015 | Caswell | B32B 1/08 362/385 |
| 2024/0011315 | A1* | 1/2024 | VanBasten | E04H 12/18 |

* cited by examiner

AIRMAST INFLATABLE TOWER

FIELD OF THE INVENTION

This invention relates to inflatable structures.

SUMMARY OF THE INVENTION

The present invention is a portable inflatable tower for deploying (lifting and supporting) lighting, camera and other equipment at elevation. The portable inflatable tower of the present invention is a closed system in that the inflatable tower stays inflated following initial inflation without continuous air delivery/constant fan inflation, with the result that no power source is required to maintain inflation and thereby tower height and support, following initial inflation. According to various embodiments, the portable inflatable tower may be single stage (have a single inflation chamber), or may be multiple stage (having two or more separate inflation stages). Each inflation chamber may have a circular, oval, elliptical or rectangular cross-section. According to the multiple stage embodiments, the stages may be stacked, in which case each stage may have a smaller cross section and/or height than the stage immediately below. Alternatively, the multiple stage embodiments may include two or more parallel inflation chambers. According to some embodiments, the portable inflatable tower of the present invention will have a platform or other connection device permanently or removably attached at its top surface for securing lighting, camera or other equipment. According to other embodiments, the platform or other connection device for securing lighting, camera or other equipment may be a movable carriage and platform that may be hoisted to the top of the tower once inflated. The inflatable tower of the invention may be deployed from a vehicle, trailer, or out of a stand-alone box or other container.

An important benefit of the invention is that it may be configured to be compact, self-contained, portable and transportable in the trunk or storage compartment of an emergency/security vehicle. Accordingly, the invention fills a void in emergency response due to the critical importance to first responders of communications, lighting and camera coverage.

Accordingly, there is provided according to the invention an inflatable equipment support tower including: a portable housing, a first inflatable tube, configured to fit in said portable housing in a deflated mode; a first inflation/deflation valve attached to an air inlet/outlet of said first inflatable tube; a first equipment platform affixed to a top end of said inflatable tube; said first equipment platform configured to fit into said portable housing when said first inflatable tube is in said deflated mode. The inflatable equipment support tower of may further include an air pump attached to said inflation/deflation valve and a power source for said air pump contained in said portable housing; alternatively or in addition, the inflation/deflation valve may be configured to be attached to an external air supply source.

According to one embodiment, a second inflatable tube may be attached to a top of the first inflatable tube and be configured to fit in the portable housing together with the first inflatable tube in a deflated mode. The first and second inflatable tubes may be connected by an air valve between a top of the first inflatable tube and a bottom of the second inflatable tube to controllably allow the flow of air between said first inflatable tube and said second inflatable tube. Alternatively, or in addition, there may be provided a second inflation/deflation valve connected to said second inflatable tube for inflation of said second inflation/deflation tube independent of said first inflation tube.

The housing may be mounted on or is part of a towable trailer, may be mounted on or may be part of an emergency vehicle, and in any event, may be sized to fit inside the trunk or storage compartment of a automobile.

According to further embodiments, there may be provided second and third inflatable tubes mounted in said housing adjacent to the first inflatable tube and configured to inflate simultaneously with the first inflatable tube during deployment so that the first, second and third inflatable tubes are situated adjacent one-another following deployment. An equipment support carriage may be provided, configured to be moved to a top of said inflatable equipment support tower following inflation of the inflatable tubes. Carriage tracks may optionally be located between each of said first inflatable tube, said second inflatable tube and said third inflatable tube. The carriage track may be motorized and/or may be configured to be hoisted to a desired location via pulley and cord system either manually or using a powered winch system.

It is specifically noted that every combination and subcombination of the above-listed and below-described features and embodiments is considered to be part of the invention.

BRIEF DESCRIPTION OF DRAWINGS

The foregoing summary, as well as the following detailed description of the preferred invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
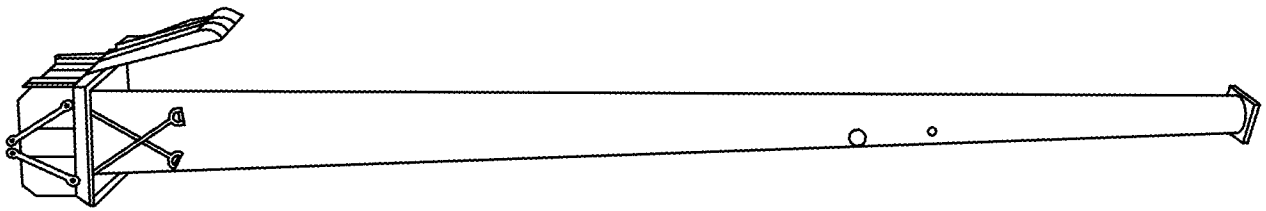
FIG. 1 shows an examples of embodiments of the invention having multiple stacked stages and deployment from a portable box sized to fit in the trunk of an automobile.
Figure 2:
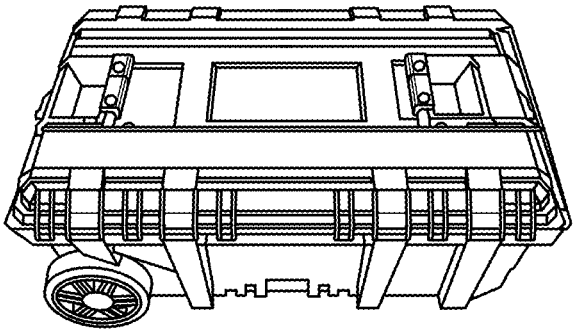
FIG. 2 shows an example of the portable box shown in FIG. 1
Figure 3:
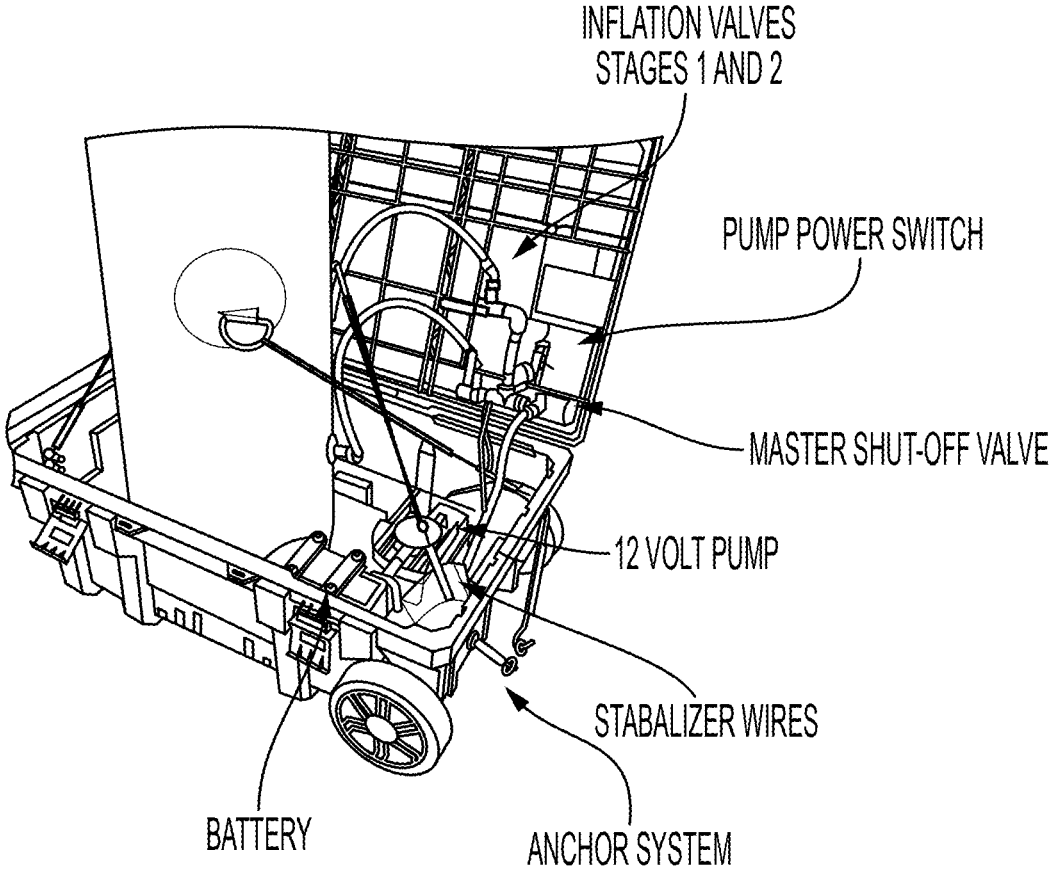
FIG. 3 is a view of the interior of the box shown in FIGS. 1 and 2.
Figure 4A:
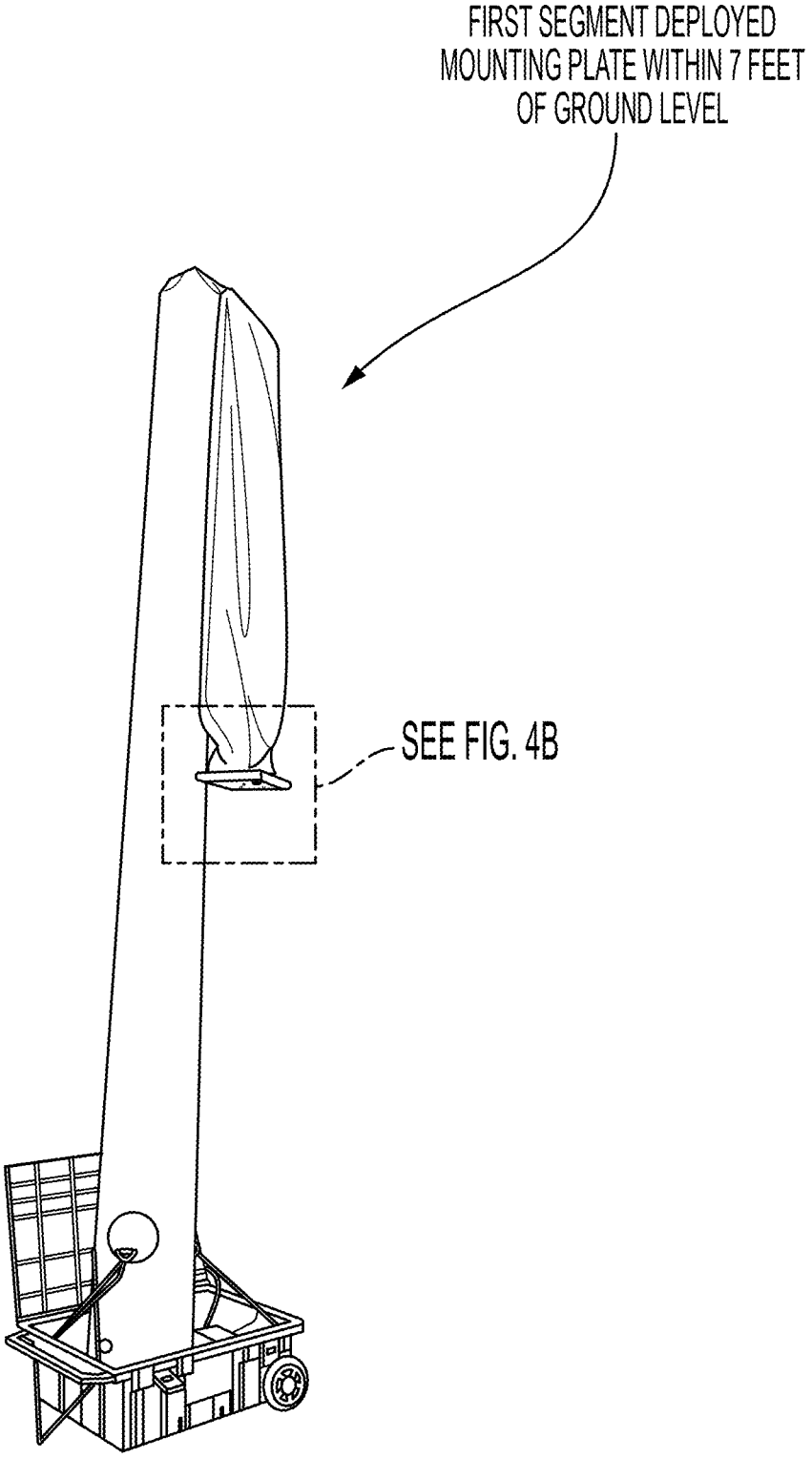
FIGS. 4A and 4B shows the embodiment of FIG. 1, with only the lower stage inflated.
Figure 4B:
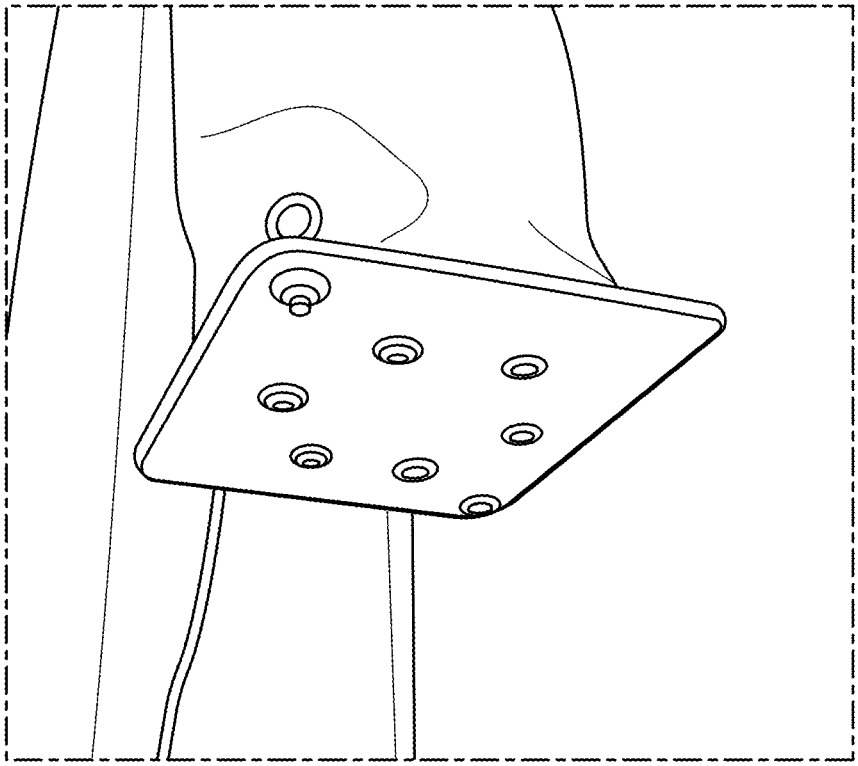
Figure 5:
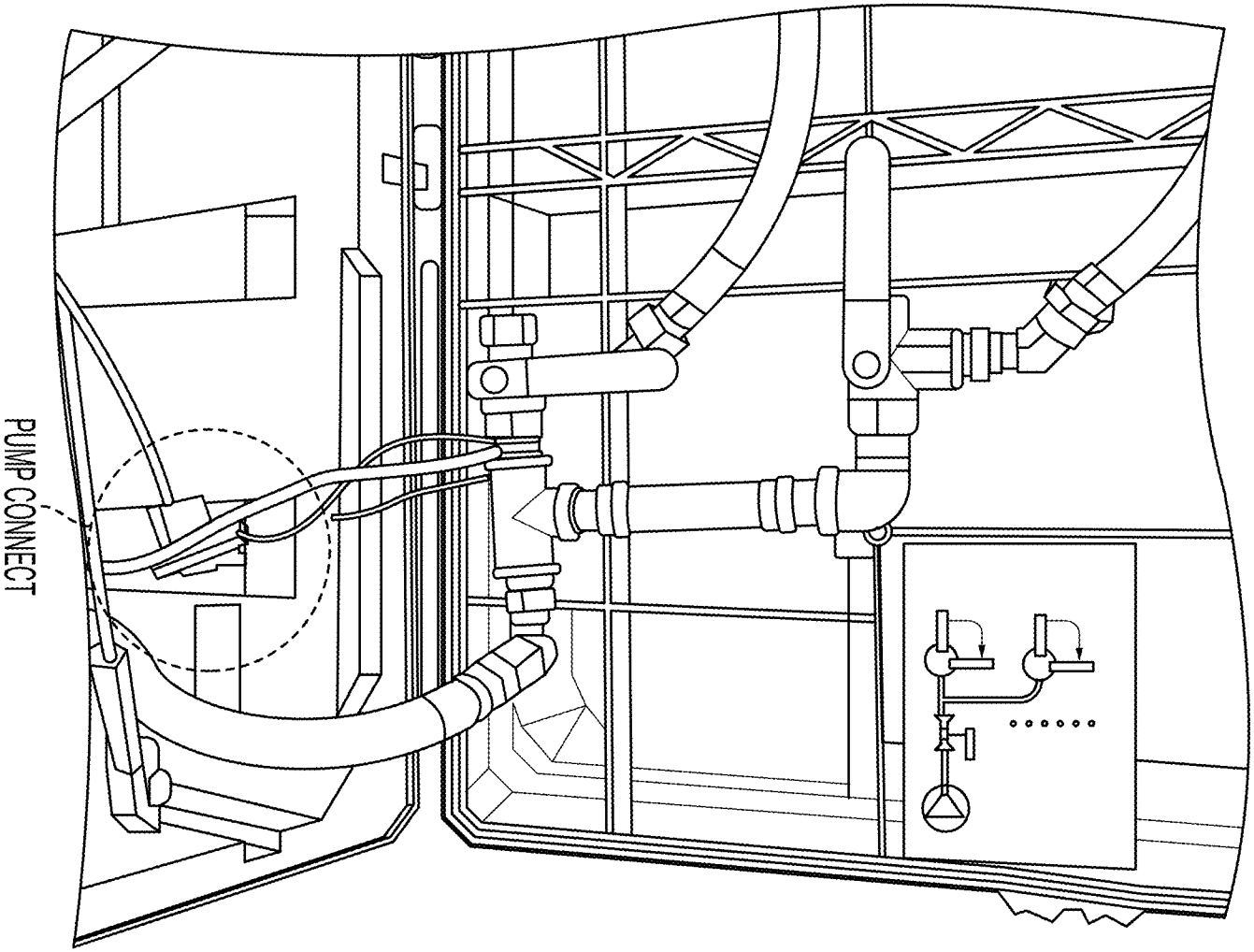
FIG. 5 is a closeup of the inflation valves in the embodiment of FIGS. 1-4.
Figure 6:
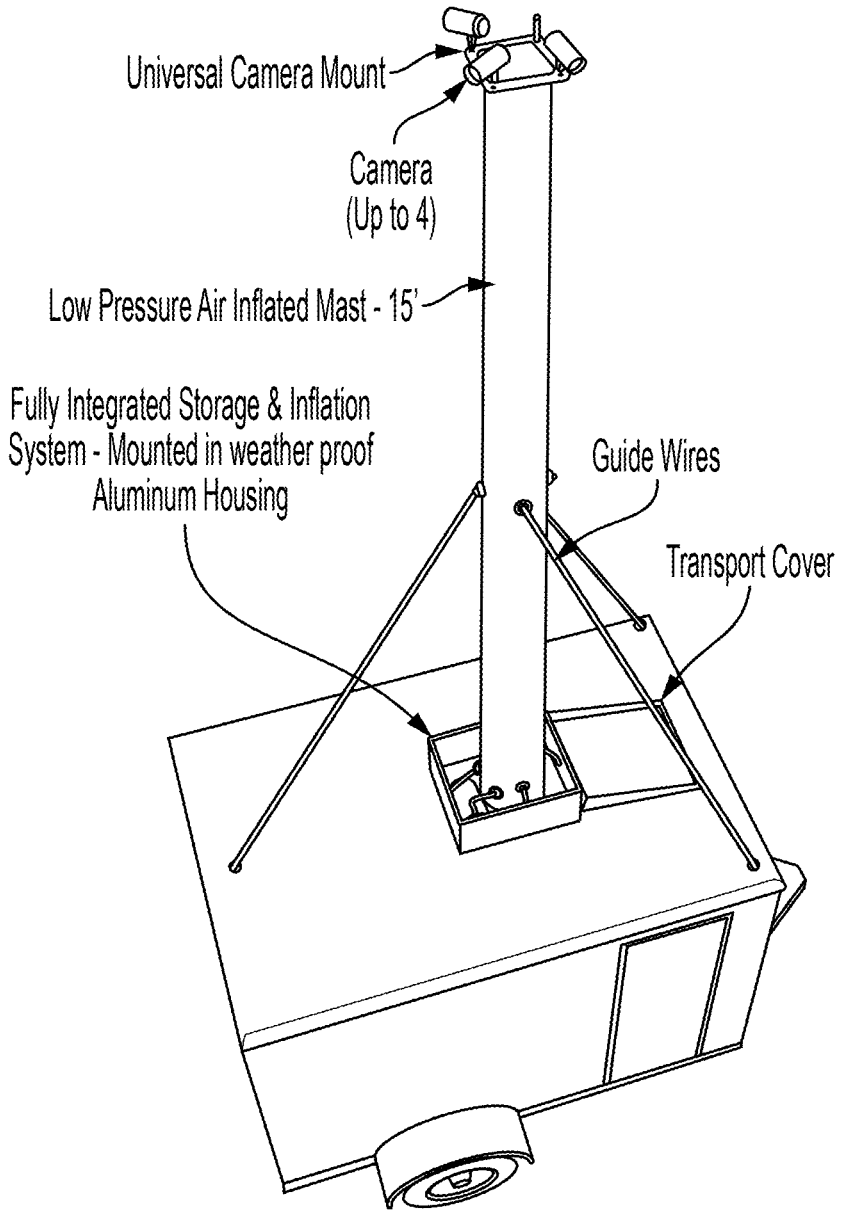
FIG. 6 shows an example of a trailer mounted embodiment of the invention.

With references to the above Summary of the Invention and FIGS. 1-6 one embodiment of the invention features two or more inflatable tubes staked on top of one-another. This multi-stage feature provides ease of deployment and striking as well as increasing weight capacity during deployment. Each inflatable tube/chamber may be separated by a bulkhead of like material or, by neoprene discs adhered to the top surface of the lower tube and bottom surface of the upper tube. An inflation system is provided so that each stage may be deployed independently with respective inflate/deflate air valves. According to other embodiments, an automatic system for deploying each stage may be provided in which the bulkheads that separate the chambers/stages are outfitted with a one way pressure regulated gate valve allowing flow to go into the following stage once a certain pressure has been reached in the previous stage. The inflation system and valves maintain relatively low pressure (~3 to 10 PSI) air as compared to systems that require constant airflow from a fan unit or pump to remain deployed.

The stacked stage embodiment preferably features a tapered mast design for enhanced strength at the base and reduced wind load higher up.

According to further optional features, the invention may be outfitted with a secondary "air tube assist" system to deploy heavier loads at critical stage connection points.

According to preferred embodiments, the material of the inflation tubes may be a lightweight approximately 20 oz/sq yard polyester reinforced double side coated neoprene, air retaining fabric. According to an alternate embodiment, the air tube material may be urethane/vinyl or PVC, air retaining, heat or RF weldable material as used in life rafts and life vests.

The bottom of the lower tube may be fitted with a 1" Neoprene base mechanically fastened (e.g., bolted) to a housing or transport case. According to preferred embodiments, housing may be portable and may include the inflation/air retention system as well as the inflatable tubes. The housing may be fitted with wheels, and, depending on size, may be mounted to a vehicle or trailer. According to various embodiments, the housing may contain the air supply system, e.g., air compressor or pump and power system (e.g., battery or electric/gas powered motor). According to alternative embodiments, the housing may contain inflation/air retention/deflation valves, and the system may be configured to be attached to an external air supply system and/or power supply.

Alternatively, the system may be deployed with stored air tank such as SCBA (self-contained breathing apparatus) air bottle as used by firefighters and this independent of any electrical power source.

According to preferred embodiments, the invention may be provided with integrated guide wires for additional stabilizing of the air tubes once deployed. In the case of the portable case embodiment, the case itself may be stabilized by anchoring it to the ground/pavement, etc.

Figure 7:
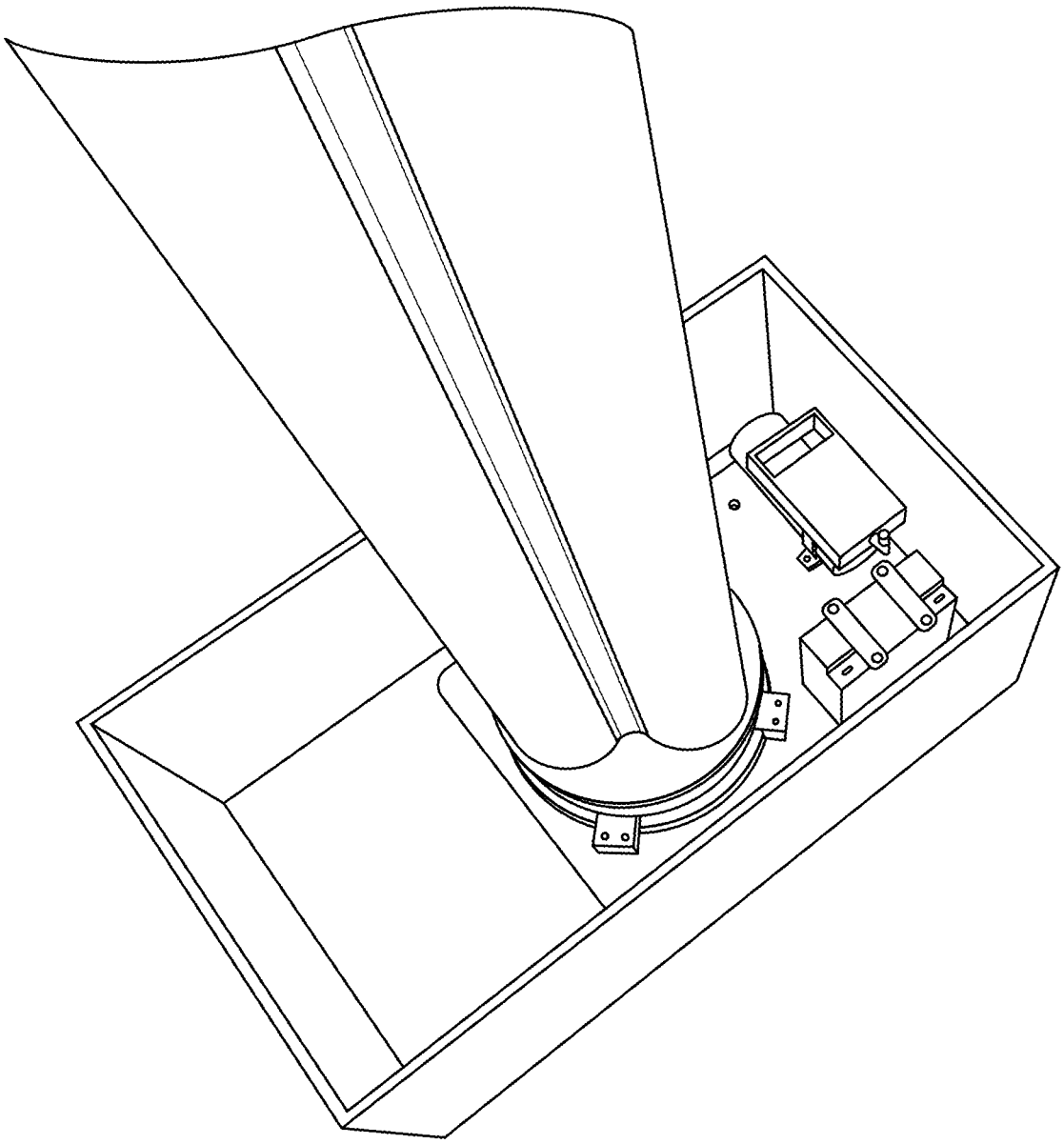
FIG. 7 is a partial perspective view of the lower part of an example of a parallel inflation chamber embodiment of the invention.
Figure 8:
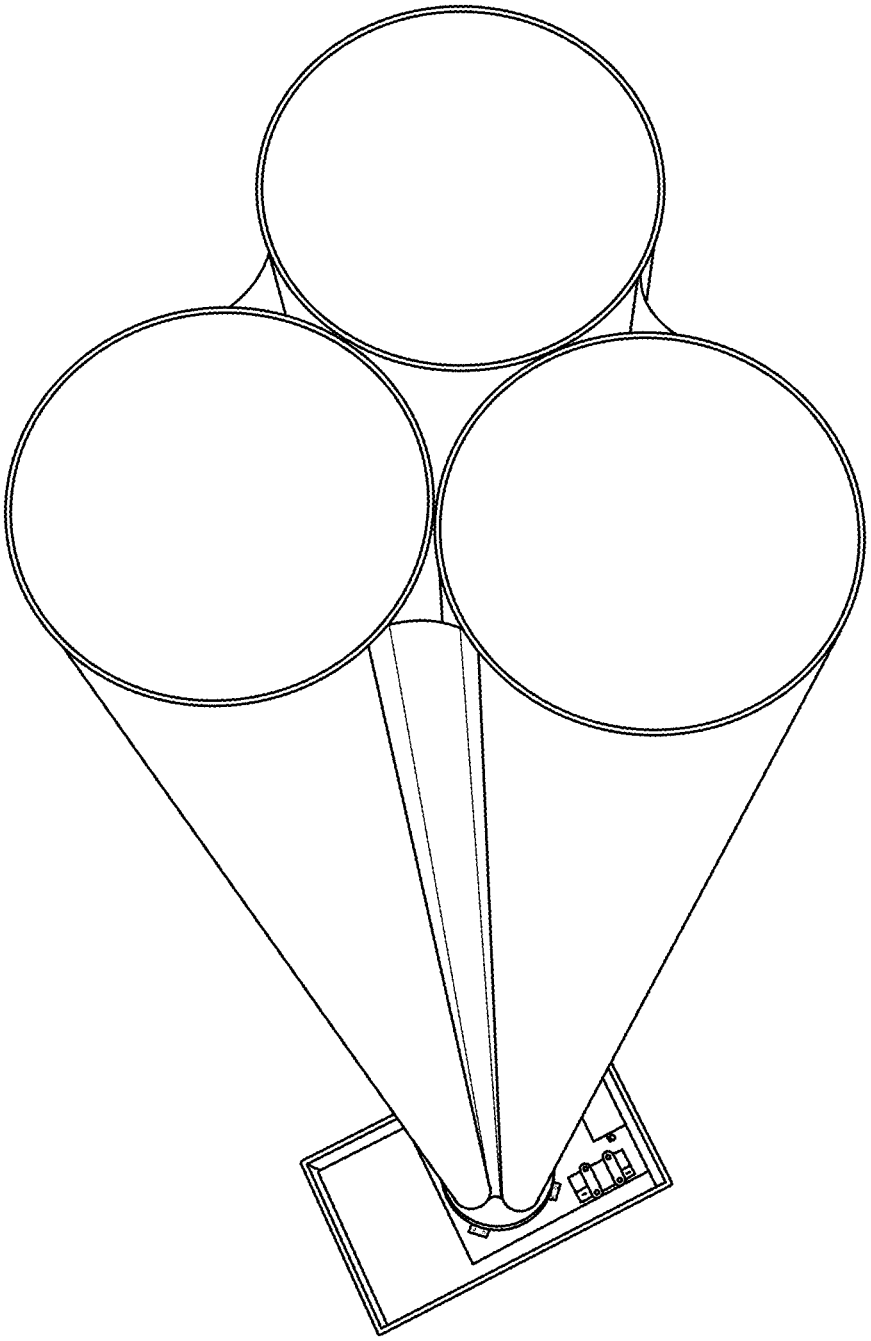
FIG. 8 is a full perspective view of the embodiment of FIG. 7.
Figure 9:
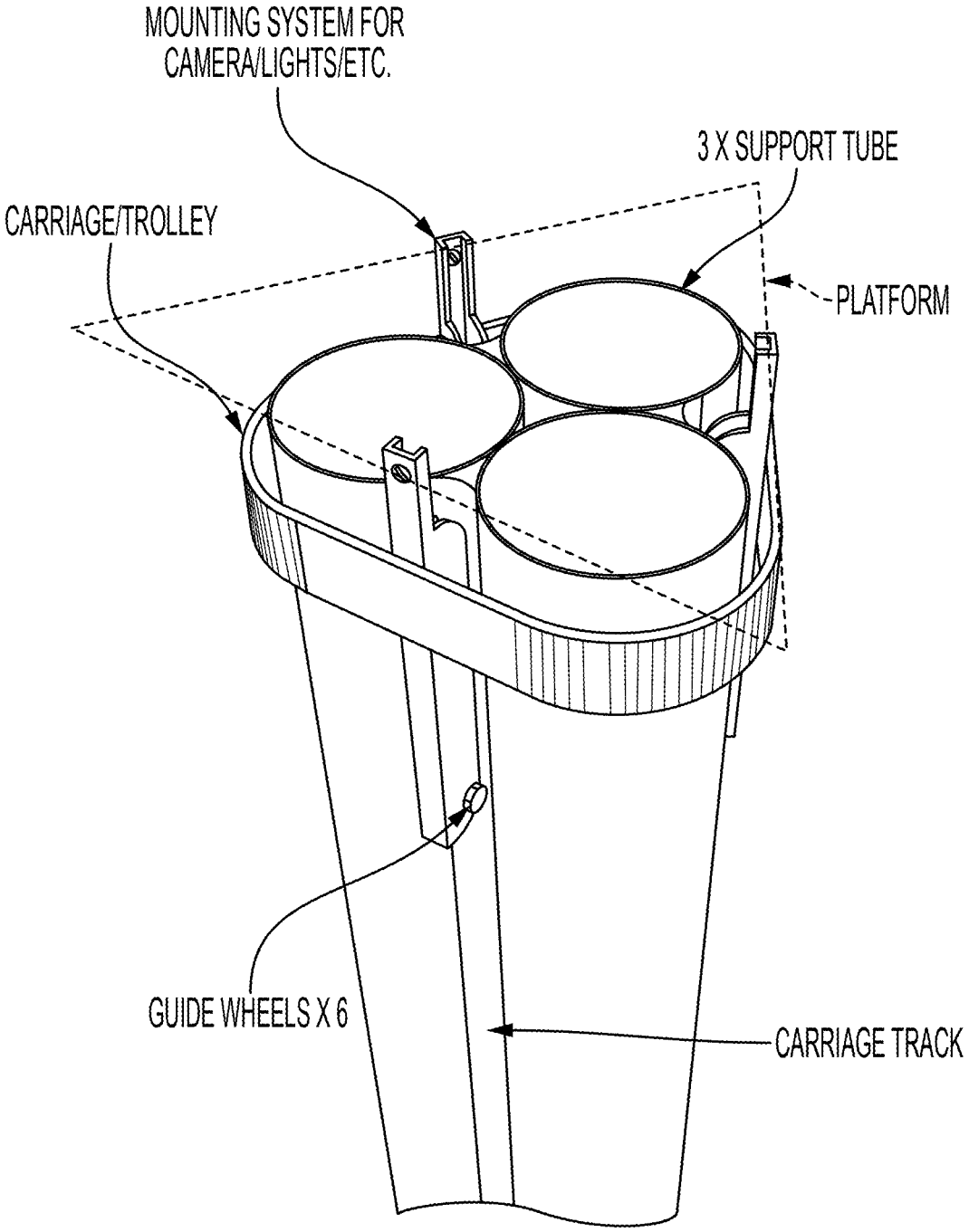
FIG. 9 is a partial perspective view of the upper part of the embodiment of FIGS. 7 and 8, with the mobile equipment attachment device (in this case, a "trolley") in the fully deployed/elevated position.
Figure 10:
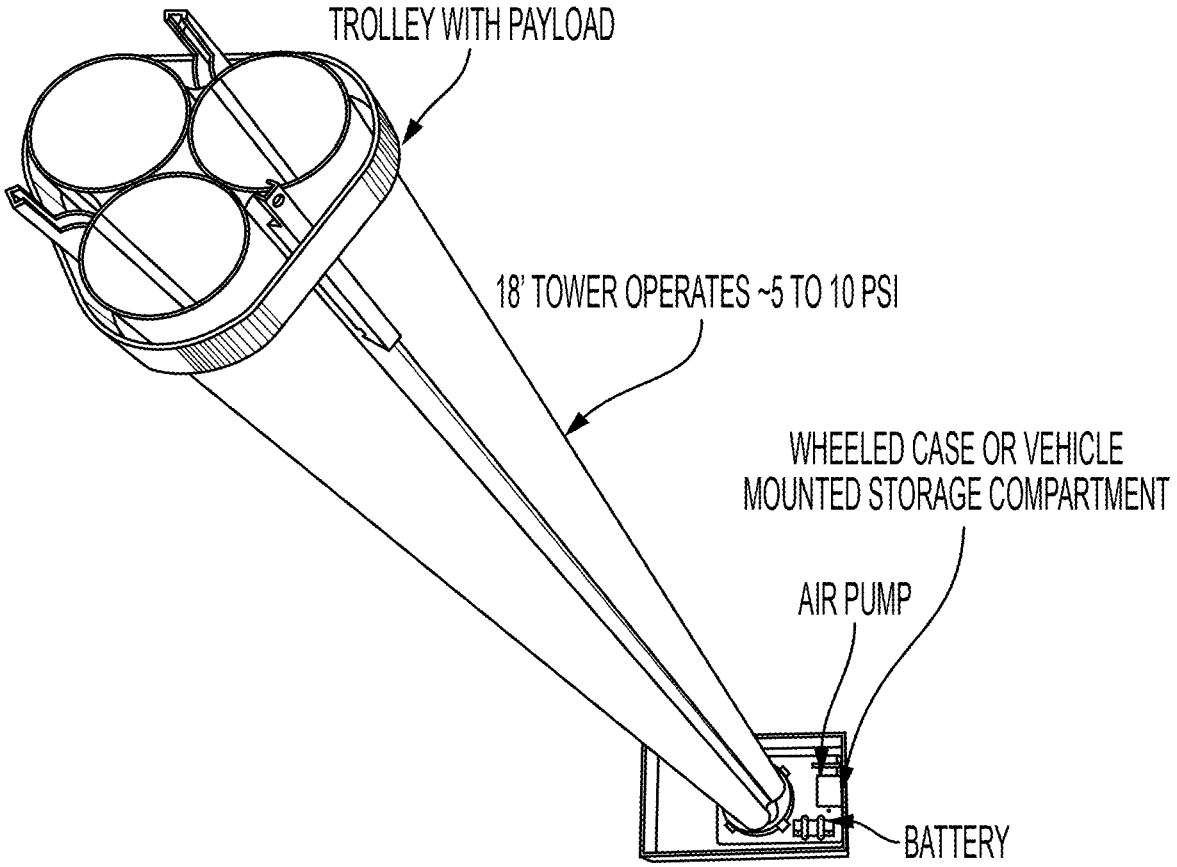
FIG. 10 is a full perspective view of the embodiments of FIGS. 7-9 with the mobile equipment attachment device in the fully deployed/elevated position.

Referring to FIGS. 7-10, a multiple parallel/adjacent inflation chamber embodiment is described. According to this embodiment, two or more inflation tubes, approximately 4" to 8" in diameter, are arranged laterally adjacent to one-another. FIGS. 7-10 show a three-tube embodiment, although more tubes may be used for taller and/or stronger towers, depending on equipment weight and required deployment height. A motorized or hoistable carriage, is arranged around or adjacent the inflation tubes and is configured to be raised, after any desired equipment has been attached, such as satellite broadcasting/receiving system, camera's, flood lights, etc. The carriage may be fitted with wheels to roll up the side of the tower during hoisting. Alternatively, the carriage may be fitted with skis/skids to slide up the tower during hoisting. The junctions between adjacent tubes may feature flexible tracks to receive the carriage wheels or skis. The tracks may be of the same material or different material as the inflatable tubes, and may be integrally formed with the tubes, or glued to the exterior of the tubes. In any event, the track material must be sufficiently flexible to collapse and folded with the inflatable tubes during breakdown for packing and transport. In the case of a motorized carriage, the motor for driving the carriage up the tower may be mounted on the carriage or may be mounted in the housing and connected to the carriage via power cord. In the case of a hoistable carriage, a pulley system may be fitted at the top of the inflatable tubes, and the carriage may be hoisted manually or via powered winch. The frame of the carriage may include a sturdy equipment platform and may be designed/configured so that the platform sits above the top of the inflation tubes to provide 360 degree field of view/broadcast/reception. According to this embodiment, the inflation of the tower and the hoisting of the equipment carriage preferably take place independently. The case, pump, valves, mounting, leveling systems and battery for this embodiment may be the same as with the embodiments of FIGS. 1-6, including the both the fully portable case embodiment of FIG. 5 and the vehicle/trailer mounted embodiment of FIG. 6.

According to preferred embodiments, the inflation tubes are first inflated, and then the equipment carriage (carrying lights, cameras, broadcast/receiving equipment, etc.) is raised to the deployed position which can be anywhere along the height of the inflated tower. The hoisting can take place manually or via electric winch or other powered mechanism.

Advantages of this Embodiment Include

- Significantly more rigid multi parallel connected chamber design.
- Reduced volumetric air requirement as compared to single larger diameter tube therefore improving speed of deployment by ~30%.
- Capable of higher pressures due to smaller diameter thus increasing ability to deploy heavier loads.
- Redundant safety due to triple chamber feature. Each chamber can be isolated with check valves thus offering the redundant deployed erect shape should one chambers/tubes fail or be damaged for any reason.
- Much improved tethering system whereby stabilizing tethers may be attached to the carriage and secure the load from wind forces wherever it is positioned along the mast.
- An improved hoist & trolley system extending above the actual tower for 360 unobstructed vision with camera's and light beacons.
- The top of the inflatable tubes may have a second lightweight-capable upper platform to accommodate light camera or safety beacon as described for the embodiment of FIGS. 1-6 which can be deployed with or without the use of the carriage/equipment platform.
- This embodiment may employ manual or powered (e.g., electric winch) hoist/pulley systems. Alternatively, the carriage may be motorized.
- Design can be scaled to much larger and taller systems should the need arise.

It will be appreciated by those skilled in the art that changes could be made to the preferred embodiments described above without departing from the inventive concept thereof. It is understood, therefore, that this invention is not limited to the particular embodiments disclosed, but it is intended to cover modifications within the spirit and scope of the present invention as outlined in the present disclosure. It is specifically noted that every combination and sub-combination of the above-listed and below-described features and embodiments is considered to be part of the invention.

The invention claimed is:

1. An inflatable equipment support tower comprising:

a portable housing, a first inflatable tube, a second inflatable tube, and a third inflatable tube, configured to fit in said portable housing in a deflated mode;

an inflation/deflation valve attached to an air inlet for said first inflatable tube, said second inflatable tube, and said third inflatable tube;

an equipment platform configured to fit into said portable housing when said first inflatable tube, said second inflatable tube, and said third inflatable tube are in said deflated mode, said first inflatable tube, said second inflatable tube, and said third inflatable tube configured to be adjacent one-another following deployment.

2. The inflatable equipment support tower of claim 1 further comprising an air pump attached to said inflation/deflation valve and a power source for said air pump contained in said portable housing.

3. The inflatable equipment support tower of claim 1, wherein said inflation/deflation valve is configured to be attached to an external air supply source.

4. The inflatable equipment support tower according to claim 1, wherein said housing is mounted on or is part of a towable trailer.

5. The inflatable equipment support tower according to claim 1, wherein said housing is mounted on or is part of an emergency vehicle.

6. The inflatable equipment support tower according to claim 1, said second and third inflatable tubes configured to inflate simultaneously with said first inflatable tube during deployment.

7. The inflatable equipment support tower according to claim 6, further comprising carriage travel tracks located between each of said first inflatable tube, said second inflatable tube and said third inflatable tube.

8. The inflatable equipment support tower according to claim 1, said equipment platform comprising an equipment support carriage configured to be moved to a top of said inflatable equipment support tower following inflation of said first inflatable tube, said second inflatable tube and said third inflatable tube.

9. The inflatable equipment support tower according to claim 8, wherein said equipment support carriage is motorized.

10. The inflatable equipment support tower according to claim 8, wherein said equipment support carriage is configured to be hoisted to a desired location via pulley and cord system.

* * * * *